United States Patent [19]

Häussler

[11] Patent Number: 4,727,792

[45] Date of Patent: Mar. 1, 1988

[54] HYDRAULIC HOLDING VALVE

[75] Inventor: Hubert Häussler, Schweiz, Switzerland

[73] Assignee: Beringer-Hydraulik, GmbH, Neuheim, Switzerland

[21] Appl. No.: 849,111

[22] Filed: Apr. 7, 1986

[30] Foreign Application Priority Data

Apr. 11, 1985 [DE] Fed. Rep. of Germany ..... 3512894
Apr. 18, 1985 [DE] Fed. Rep. of Germany ..... 3514007

[51] Int. Cl.[4] ..... F15B 13/042
[52] U.S. Cl. ..... 91/420; 137/493.3
[58] Field of Search ..... 91/420; 137/493.3

[56] References Cited

U.S. PATENT DOCUMENTS 3,906,991 9/1975 Haussler ..... 91/420 X
4,172,582 10/1979 Bobnar ..... 91/420 X
4,223,693 9/1980 Kosarzecki ..... 91/420 X

FOREIGN PATENT DOCUMENTS 3239930 5/1984 Fed. Rep. of Germany .

*Primary Examiner*—Robert G. Nilson
*Attorney, Agent, or Firm*—Bell, Seltzer, Park & Gibson

[57] ABSTRACT

A hydraulically controllable, leakproof holding valve is disclosed, and which is adapted to be attached in the lifting hydraulic line leading to a working cylinder or the like. The holding valve includes a slidably mounted control piston, which functions as a controlled non-return valve during periods when the working cylinder is stationary or being lifted, and the piston also functions as a throttling valve during periods when the working cylinder is being lowered.

13 Claims, 3 Drawing Figures

HYDRAULIC HOLDING VALVE

Figure 1:
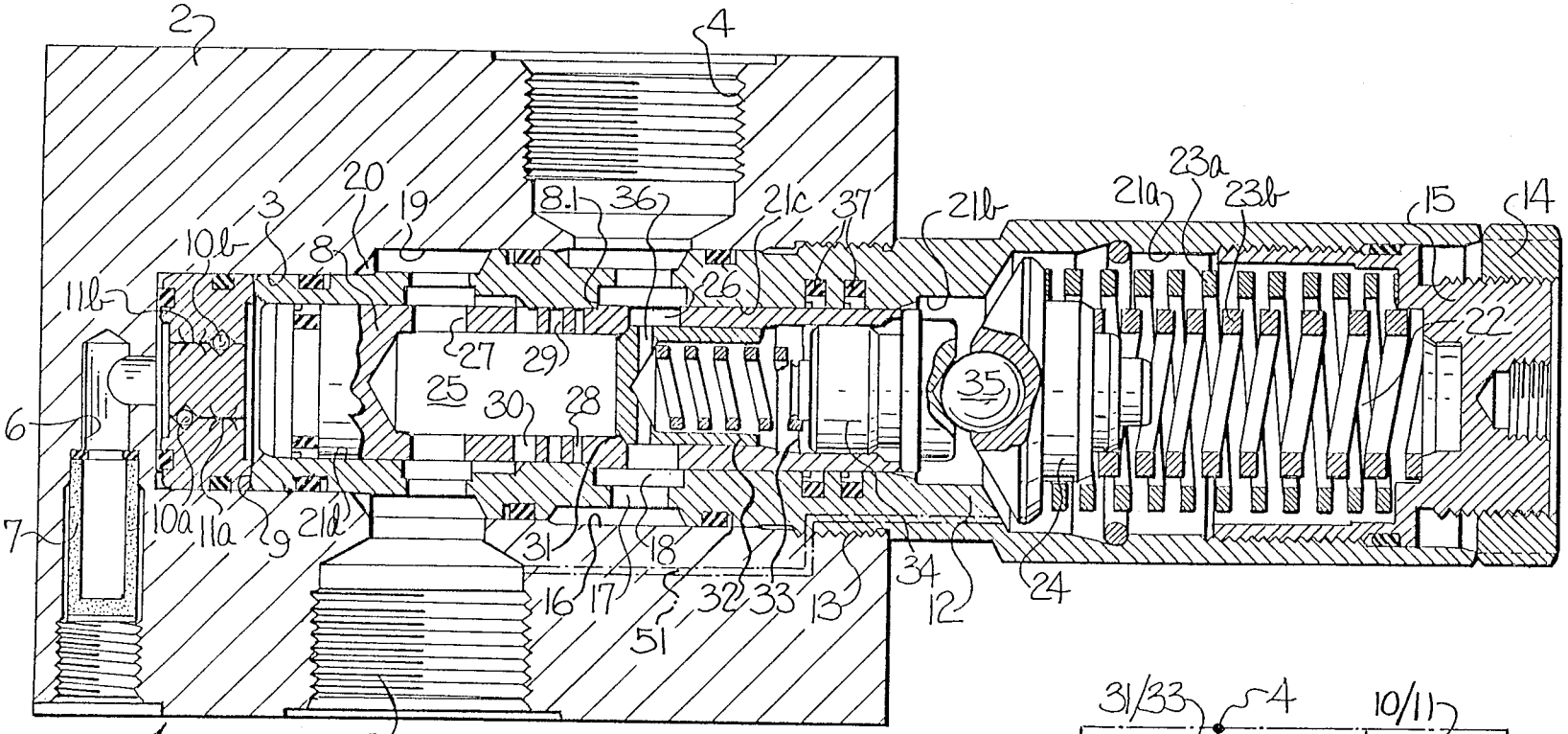

The present invention relates to a hydraulic holding valve of the type used in the lifting line of hydraulic systems to prevent the uncontrolled fall of a hoist, boom, or the like upon line breakage.

Holding valves of the described type are typically connected directly to the working cylinder of the hydraulic system, and are prescribed according to German Industrial Standard DIN 24093 for the operation of hoisting equipment and the like so that the boom or other lifted member does not drop in an uncontrolled manner in the event of line breakage. To provide automatic operation of the valve in the event of a line break, such prior holding valves commonly include a non-return valve which immediately closes the flow path between the working cylinder and a pilot valve which connects the working cylinder with a hydraulic pump and a supply tank for the hydraulic fluid, during the lifting and lowering operations. A holding valve of this type is further described for example in Swiss patent No. 543,028 and corresponding U.S. Pat. No. 3,906,991.

Another known holding valve comprises a hollow, regulating slide valve which is axially movable in a valve casing, and in which there is positioned a non-return valve and a parallel closing member which is actuated by the stem of a servo piston. In this known arrangement, the control piston and the second control piston which is connected in series in the flow path, are biased by the same pressure of a precontrol device.

The known holding valve which has a second servo control closing member for the sealing of the flow passages in the valve casing, involves a high constructional cost by reason of the additional functional elements and control lines, which also requires increased space to accommodate these components.

The essential functions of a hydraulically controllable holding valve include the following:

(a) It will prevent a load from falling in the lifting or upward operation in the event of a line break, by providing a non-return valve in the flow path;

(b) It will permit a controlled downward movement in the lowering direction, also in the event of a line break, by providing a hydraulically controllable throttle valve; and (c) It will prevent a slow uncontrolled lowering of the load at a standstill position, by providing a leak proof stop valve.

It is accordingly an object of the present invention to provide a hydraulically controllable holding valve of compact design, and which effectively provides the above noted essential functions in a single control piston. In this regard, the present invention provides that the ports provided in the valve casing are essentially free of leakage, and the design and construction of the valve comprises a relatively small number of functional elements, so that the space and weight are such as to permit the direct installation or attachment to the consumer.

These and other objects and advantages of the present invention are achieved in the embodiment illustrated herein by the provision of a hydraulic holding valve which comprises a valve housing have a bore therein and which includes separate, first, second, and third fluid channels communicating with the bore at axially spaced apart locations. A control piston is slidably mounted in the bore, and the piston and bore defines first one-way fluid passage means and second throttling fluid. passage means, with the second throttling fluid passage means including a leak proof seat valve formed between the bore and piston. The piston is slidably mounted in the bore for movement between a first axial position wherein the seat valve is closed and the first one-way passage means communicates between the first and second fluid channels, and a second axial position wherein the seat valve is open and the second throttling means communicates between the first and second fluid channels. Spring biasing means is also provided for biasing the piston towards its first position, and a control space is provided which communicates with the third fluid channel, for biasing the piston toward its second position upon a pressurized fluid being delivered thereto.

In the operating system, the first and second fluid passages are connected in the lifting line leading from the pump to the consumer, and the third fluid passage and thus the control space is connected to the lowering line. Also, the one-way fluid passage means is oriented so that fluid passage therethrough is precluded in the direction from the consumer to the pump.

The holding valve of the present invention distinguishes itself in that a one-way valve function, a throttling valve function, and a leak proof valve seat function are all integrated in the control piston, and it may be assured that the spring biasing means which effects the sealing of the valve is adequate to close the control piston against the hydraulic forces tending to open the seat valve, and in addition, that the spring may be designed sufficiently weak so as to be readily overcome by the pressure forces operative on the control piston in the control space. The prior practices in the trade have avoided a construction of the non-return valve in which the control piston has the function of a leak proof seat valve as well as a throttling function, which gave rise to the use of several valves in series with different functions, note for example German patent A 32 39 930.

In a preferred embodiment, the control piston includes an annular shoulder which is designed to mate with an annular seat in the bore of the valve housing to provide the leak proof seat valve. The annular shoulder of the control piston is designed sufficiently large so that, on the one hand, high surface pressures and jamming or clogging of the piston in the longitudinal bore of the valve casing are avoided. Also, the annular shoulder is sufficiently small so that at the maximum tolerable load pressure, the force of the spring biasing means is greater than the hydraulic force on the annular shoulder, so that there always remains a closing pressure which is adequate for a leak proof seal. The upper limit of the spring force is controlled by the maximum applicable force exerted by the pressure of the fluid in the control space. As a result, the difference in diameters of the annular shoulder ranges preferably from 0.2 to 0.5 mm. The spring biasing means is in the form of a spring which is held in a cylindrical cavity, and which engages the control piston. The spring is so designed that even at the maximum tolerable pressure on the annular shoulder of the control piston, the hydraulic axial force is less than the oppositely directed spring force which is operative on the control piston. Thus even at the tolerable maximum pressure, the control piston remains held in its closed position, and the flow passage therethrough remains closed. On the other hand, the load pressure on the consumer may, in a controlled manner, be regulated downwardly to a desired lower value, by biasing the control piston with the fluid pressure in the control space.

In a preferred embodiment, the holding valve further comprises an outer support casing having a bore therein, and the valve housing is threadedly mounted in the bore of the support casing. By this arrangement, the valve seat in the valve housing, which preferably should comprise a hardenable material, can be formed in a housing of a suitable surface hardenable material, which is removably insertable into the bore of the outer valve casing. The housing is of unitary construction, and encloses all of the functional elements of the valve, including the cylindrical cavity for the spring, and such that the housing may be inserted as a structural unit into the outer support casing. This results in that the outer support casing need not be made of a corresponding, hardenable material, or that other arrangements be made to provide for a hardened valve seat in the valve housing.

It should also be mentioned that it is also possible to alternatively harden the surface of the annular shoulder of the control piston, so that the housing and valve seat may be of a softer material.

In the preferred embodiment, the spring biasing means comprises at least two control springs which are concentrically mounted, and so that they are clamped between a spring plate and an axially ajustable locking screw. The control springs are helically wound of a spring wire having a rectangular or a square cross section, and the longitudinal spacing of the spring coils in the non loaded condition is less than the longitudinal width of the coils as viewed in the longitudinal cross section. These characteristics provide an additional protective function in the event of a spring break. In particular, the spring construction prevents the coils of the spring adjacent the point of rupture from being pushed into each other. On the assumption that it is not necessary to be concerned that two of the springs may break at the same time, the present construction provides that upon the break of a single spring, a predetermined force will be maintained, which prevents the control piston from suddenly releasing the pressure in the lifting line of the hydraulic system. It is preferred that this predetermined force is greater than the hydraulic force which is operative on the annular shoulder at the maximum load pressure.

The springs are preferably mounted in a hermetically sealed cavity in the valve housing. The cavity may be hermetically sealed by a plug which is threaded into and secured in the valve housing, and the cavity may be maintained under a pressure less than atmospheric pressure. In this case, it must be insured that the control piston is mounted so as to be absolutely free of leakage relative to the spring cavity. This may be accomplished by the use of at least one annular seal, and preferably by the use of twin seals. Another possibility is that the spring cavity is under atmospheric pressure and includes a corresponding air vent. In such case, it is desirable that the functional elements disposed in the spring cavity be made of a corrosion resistant material, since moisture cannot be prevented from entering into the spring cavity under the conditions in which the holding valve may be used. Thus there may be provided an air filter in the air vent, so as to prevent impurities from entering into the spring cavity. It is also possible to provide communication between the hermetically sealed spring cavity and the multi-way valve connection, such as by means of a duct which extends through the valve housing, and such that depending on how the valve is switched, the spring cavity may be connected with the source of pressurized fluid or with the fluid tank. Finally, the spring cavity may also be connected via a separate line to the supply tank for the pressurized fluid. This will prevent the fluid entering into the spring cavity by leakage from generating a back pressure, by reason of the pressure head, which makes the behavior of the holding valve dependent on the respective operating condition of the flow. The leaking oil is immediately discharged into a pressureless tank.

Figure 2:
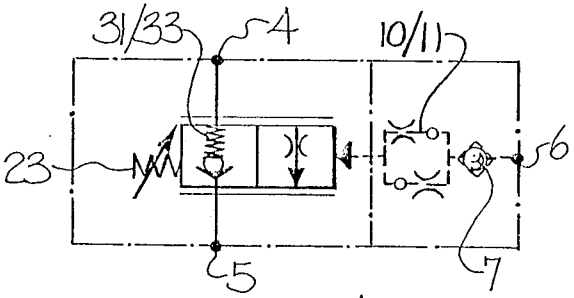
Figure 3:
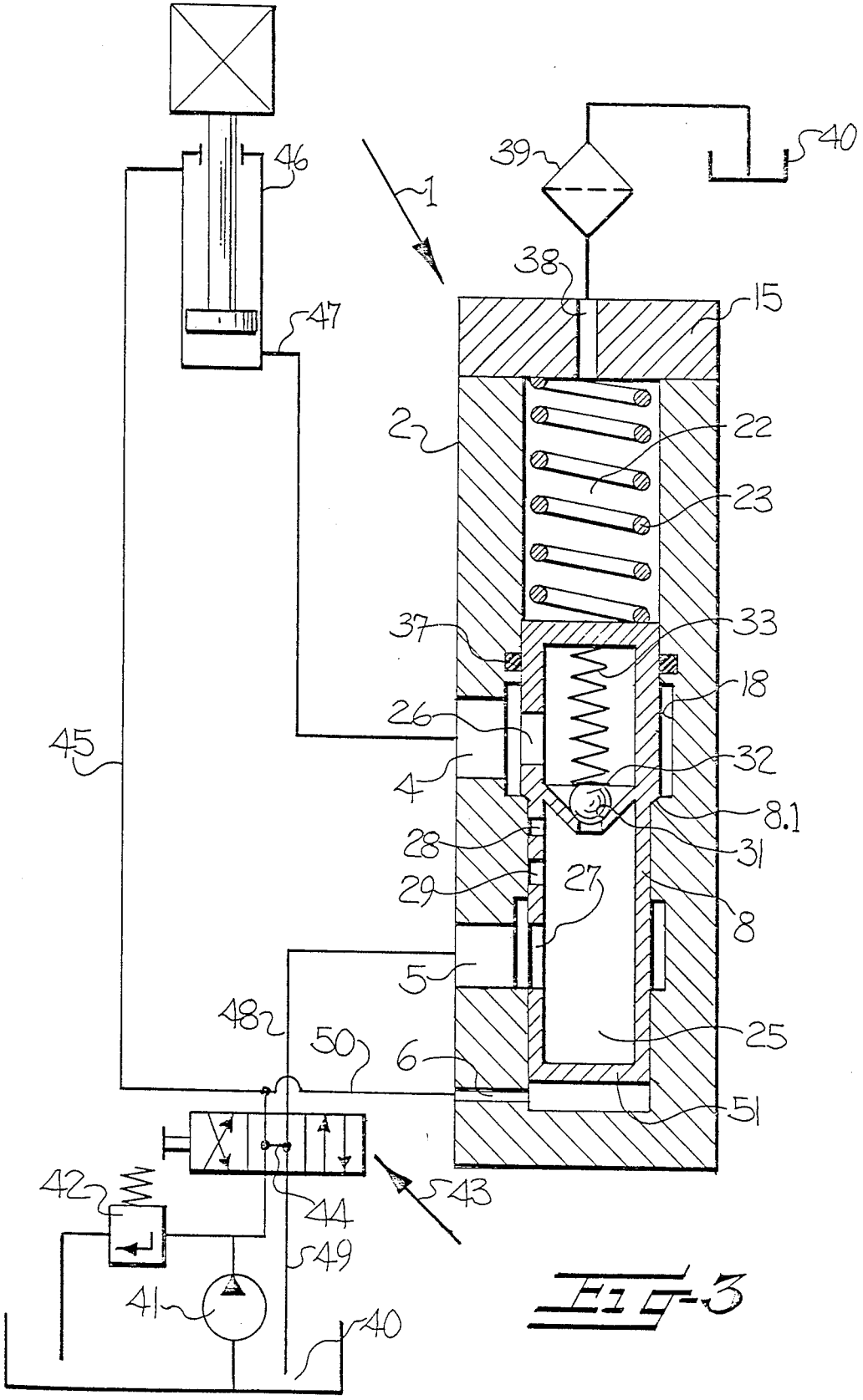

Some of the objects and advantages of the present invention having been stated, others will appear as the description proceeds, when taken in conjunction with the accompanying drawings, in which FIG. 1 is a longitudinal sectional view of a holding valve which embodies the features of the present invention;

FIG. 2 is a schematic hydraulic circuit diagram of the valve shown in FIG. 1; and FIG. 3 is a somewhat schematic view of the holding valve of the present invention, and being shown in the operating system which includes the pump and consumer.

Referring more particularly to the drawings, FIG. 1 illustrates a preferred embodiment of a holding valve 1 which includes the features of the present invention. As shown in this longitudinal sectional view, the valve 1 consists of a valve casing 2 having a blind-end bore 3 with a number of stepped diameter portions. First and second axially spaced apart transverse bores 4 and 5 extend through the wall of the casing, preferably at a right angle, to which there are connected a hydraulic consumer 46 (FIG. 3) and a standard four-way directional control valve 43. The valve casing 2 is so constructed that its consumer connection 4 may be directly connected to a hydraulic working cylinder or the like, whereas transverse bore 5 leads, via a pipe or hose line 48, to a directional valve 43, which permits the holding valve 1 to be connected with a hydraulic source of pressure, for example, a pump 41 or the like, or with a supply tank 40. Terminating in the bottom of blind-end bore 3, is a third transverse bore or control connection 6, the diameter of which is stepped, and into which there is inserted a filter element 7. Transverse bore 6 is provided for the connection of a control line 50, to apply a control pressure on the front surface of control piston 8 of the holding valve 1 as further described below.

A connecting plug 9 is positioned in the blindend bore 3 of the valve casing, and the plug is sealed therein by means of an annular packing ring. The connecting plug 9 has two axial passages for a pressure medium, of which each is provided for a certain direction of flow and closed by an associated non-return valve **10*a*, 10*b* in the opposite direction of flow. Disposed in front of each non-return valve 10*a*, 10*b***, is a throttle ll*a*, **11*b*** to dampen vibrations.

The outer end of the bore 3 is provided with an internal screw thread 13, and an integral valve housing or sleeve 12 is threadedly positioned in the bore 3 with its forward end in contact with the connecting plug 9. The sleeve 12 is similarly stepped off in its diameter and it accommodates all of the essential, functional elements of valve 1. Sleeve 12 is axially closed at its rear end which projects from valve casing 2 by a screw plug 15 which is locked by nut 14.

An annular channel 16 is provided on the external surface of sleeve 12, in the area of consumer connection 4, which connects through a transverse bore 17 to an annular channel 18 on the inside surface of sleeve 12, for the purpose of creating a flow connection. A corresponding flow connection is provided in the area of valve connection 5 leading to the valve 43. However, here, an annular channel 19 corresponding to annular channel 16 is formed by a reduced diameter of sleeve 12 and the axially displaced, radial step 20 of the blind-end bore 3 in valve casing 2. Annular channels 16 and 19 are hydraulically separated from each other as well as from thread 13 and connecting plug 9 by annular packings which are not described in further detail, and which are inserted in axially spaced-apart annular grooves.

The sleeve 12 has also several steps 21*a*–*21d* in its longitudinal bore, which are axially spaced apart. A spring cavity 22 is formed in the area 21a where the inside and outside diameters of sleeve 12 are largest. Clamped into spring cavity 22 are two control springs 23*a* and 23*b* which concentrically extend into each other and are held between a spring plate 24 and the locking screw plug 15. The control springs 23 are preferably coil springs, which are wound from a spring wire having a rectangular or square cross section, so that the coils are prevented from being pushed into each other upon a possible break of the spring. Also, as seen in FIG. 1, the longitudinal spacing of the coils in the unloaded condition is less than the longitudinal width of the coils in cross section.

A control piston 8 is mounted for slidable movement in the bore portions 21*c*, 21*d* of the sleeve. The piston 8 is formed with stepped diameter portions, so as to provide a conical annular shoulder 8.1 which is designed to mate with a cooperating valve seat in the bore of the sleeve 12. As a result of their axial setting by screw plug 15, the springs 23 are biased so that, at the maximum tolerable pressure on consumer connection 4, the spring force preponderates the hydraulic axial force which occurs on the annular shoulder surface 8.1 of the control piston 8. The external surface of the control piston 8 is manufactured within close tolerances relative to longitudinal bore 21. Its surface is ground and hardened, preferably surface hardened, at least in the area of annular shoulder 8.1 because of its function and constructional design as a closing member.

In its interior, the control piston 8.is hollow, and is provided with a blind-end bore 25, which is connected with the external surface of the control piston by several, axially spaced-apart, transverse bores 26 and 27, as well as bores 28, 29, and 30. The transverse bore 26 is disposed in the area of annular channels 16 and 18 of sleeve 12 and in the area of consumer connection 4 in the valve casing. The transverse bore 27 is similarly disposed in the area of annular channel 19 and of the valve connection 5. The other transverse bores 28–30 are located axially between transverse bores 26 and 27 and have different flow cross sections, which become larger as the distance from the annular shoulder 8.1 of control piston 8 increases.

The blind-end bore 25 in the interior of control piston 8 is stepped in diameter and forms at its step a seat 31 for closing member 32 of a non-return valve, which is pressed by a closing spring 33 against its seat 31. Closing spring 33 is biased by a supporting screw 34, which is screwed into the axially open rear end of control piston 8. Spring plate 24 has a ball 35 attached thereto on its front side which lies against a spherical recess in the rear surface of supporting screw 34 and is pressed thereagainst by the spring force of control springs 23*a*, 23*b*.

Closing member 32 contains a transverse bore 36, so that its interior receives the pressure present in the consumer connection 4 of the valve casing 2.

To avoid leakage between the circumference of control piston 8 and spring cavity 22, an annular seal 37 is inserted between annular cavity 18 in the inside circumference of sleeve 12 and the area 21b of longitudinal bore 21. The seal 37 is in the form of a pair of annular rings, and it prevents the pressure medium from entering into the spring cavity and building up a pressure therein, and thus it assures that the behavior of the valve is independent from the respective operating flow condition. A fluid duct as indicated schematically by the dashed line 51 in FIG. 1, may be provided which extends between the sealed cavity 22 and the fluid channel 5.

FIG. 2 illustrates a hydraulic circuit diagram of the holding valve of FIG. 1.

FIG. 3 is a schematic view of the holding valve 1 together with a hydraulic consumer 46, in particular, a cylinder-piston assembly of an excavator, hydraulic elevator, or the like. Also, a suitable control circuit for the actuation of consumer 46 is illustrated, with corresponding numerals being used for the structural parts of the holding valve 1 which are identical to those in FIG. 1. Aside from the above described functional elements, the spring cavity 22 is here shown to be aerated and vented through bore 38 in closing plug 15 of valve casing 2. A filter 39 is interposed in the line connecting to tank 40.

Attached to the upper connection of consumer 46 is a lowering line 45, and attached to the lower connection is a lifting line 47, 48, with the holding valve 1 being interposed in the lifting line 47, 48. When directly linking connection 4 to consumer 46, naturally, the portion 47 of the lifting line is not needed. Lowering line 45 and lifting line 48 are connected, via a four-way directional control valve 43, with hydraulic pump 41 and, via a return flow line 49, with tank 40. The entire system being secured against an overload by an adjustable relief pressure valve 42. Additionally, a control line 50 branches off from the lowering line 45 at a junction and leads to control connection 6 of the holding valve. In the neutral adjustment of four-way valve 43, the pump line and tank line 49 are interconnected, so that there is a pressureless circulation.

As to the operation of holding valve 1, it will initially be assumed that the four-way valve 43 is moved to the right. This causes the line 48 to receive the pressure of the pump. As soon as a sufficiently high pressure exists on four-way valve connection 5, the hydraulic force raises non-return valve 31–33 from seat 31 and directly opens the path to transverse bore 26 of control piston 8 and to the working cylinder 46, which may be directly connected to consumer connection 4 through a twin screw nipple. In the opposite flow direction, the non-return valve becomes operative in the sense of closing and stops the flow through the axial bore or the interior 25 of control piston 8. For a controlled decrease of the pressure in working cylinder 46, i.e., lowering operation, the four-way valve 43 is adjusted to the left. The holding valve 1 is biased, via control line 50 and connection 6, by a control pressure (i.e pump pressure), which is operative in the control space at the front end of control piston 8. The piston 8 is thus axially displaced against the force of control springs 23 to such an extent that its shoulder 8.1 is raised from its seat. Depending on the the magnitude of the control pressure applied, control piston 8 is axially displaced, and a connection is made, via transverse bores 28–30 and axial bore 25, to four-way valve connection 5 and then to the supply tank for the pressure medium. Thus the load on the consumer 46 is lowered at the desired operating speed.

In the neutral adjustment of four-way valve 43 (i.e the illustrated center position), in which a pressureless circulation of the hydraulic medium occurs, there is very little pressure on control connection 6, which is slightly higher than the pressure of tank 40. As a result, spring 23 pushes control piston 8 so that the shoulder 8.1 firmly rests on its seat in the casing or in sleeve 12, respectively, whereas non-return valve 31–33 stops the return flow from consumer 46. Since the holding valve seals free of leakage, it is insured that the load stays in its momentary place and does not drop. In the event of a rupture of line 48 during the lifting operation, with the consumer 46 being directly attached to connection 4, the hydraulic medium supplied by the pump flows off without raising the load, and the closed non-return valve 31–33 prevents the load on consumer 46 from dropping.

During the lowering operation, a rupture of line 45 effects a drop of the control pressure in line 50, and thus causes holding valve 1 to close at the shoulder 8.1 and its seat by spring 23. A rupture in line 48 causes an outflow of the hydraulic medium during the return to pressureless tank 40, without increasing the lowering speed. By adjusting the four-way valve 43 to its neutral position and shutting off the pump 41, the broken line can then easily be replaced, without any additional hydraulic medium flowing off.

The control piston 8 is designed as a stepped piston. It has an axial portion with a large cross section and a large diameter, and an axial portion with a smaller cross section and a smaller diameter. Both portions of the control piston are sealably guided in correspondingly designed portions of the sleeve 12. Due to the difference of diameters, there is created on the piston and sleeve a step between the portion with the large diameter and correspondingly large cross section and the portion with the smaller diameter and the correspondingly smaller cross section. This step forms, on the piston and on the sleeve annular surfaces, each being directed in an opposite axial direction. These annular surfaces form a seat valve according to the present invention. The annular surface of the sleeve is located on the side of annular channel 18 which is directed toward the four-way valve connection 5 of the cylinder. The correspondingly shaped annular surface 8.1 on control piston 8 lies, in the closed position, against the annular surface of the cylinder. According to the invention, however, the difference between the large diameter and the small diameter of the control piston is very small. Preferably, this difference is less than about 1/10 of the small diameter. As a result, the hydraulically operative annular shoulder 8.1 which is formed on control piston 8 in the area of annular channel 18, is less than about 1/20 of the area of the control surface 51 of control piston 8 which is biased with pressure via control line 50. A hydraulically operative annular surface is here defined as the difference between the cross section of the large diameter portion of the piston and the cross section of the small diameter portion. The cross section of the small diameter portion of the piston equals the control surface 51 of the piston. As a result, it is provided that, during the lowering of consumer 46, pressure is delivered to the lowering line 45 by its connection to the pump 41. The shoulder 8.1 on control piston 8 remains closed until the pressure force on control surface 51 of piston 8, on which the pressure of lowering line 45 is operative via control line 50, preponderates the force of spring 23. As soon as the pressure force exceeds the spring force, control piston 8 is raised, and a connection is made, via transverse bores 28, 29 of the control piston and the interior of the piston, between lifting line 47 with consumer connection 4 and lifting line 48 with four-way valve connection 5. Thus, piston 8 controls the passage of lifting line 47, 48 in the lowering operation as a function of the pressure in lowering line 45. When now the lowering operation is completed, it must be insured that the consumer 46 does not drop any further in an unintended and uncontrolled manner as a result of leakages. This is accomplished in that spring 23 presses control piston 8 against the seat of the shoulder 8.1. Nevertheless, it should be borne in mind that a consumer pressure continues to exist in lifting line 47, which is proportional to the load of consumer 46. When control piston 8 is opened, this consumer pressure exerts a force on annular shoulder 8.1 of control piston 8, which is directed against the force of spring 23. However, since the annular shoulder 8.1 on the control piston is very small, and since its ratio to control surface 51 on control piston is likewise very small, it is insured that a relatively slight force of spring 23 is adequate to overcome the hydraulic forces on the shoulder 8.1 and to insure a reliable closing of the shoulder 8.1 on its seat.

In addition, the relatively weak design of spring 23 provides that, in the lowering operation, the pressure forces which are operative on control surface 51 and acting against the force of spring 23, can also be low.

In the drawings and specification, there has been set forth a preferred embodiment of the invention, and although specific terms are employed, they are used in a generic and descriptive sense only and not for purposes of limitation.

That which is claimed is:

1. A hydraulic holding valve comprising a valve housing having a bore therein, said bore having a closed inner end, an outer end, and an outwardly facing annular seat intermediate its ends to define an inner cylindrical bore portion and an outer cylindrical bore portion which has a diameter greater than that of said inner bore portion, a first fluid channel communicating with said outer bore portion, a second fluid channel communicating with said inner bore portion, and a third fluid channel communicating with said bore immediately adjacent said inner end thereof, a control piston slidably mounted in said bore and comprising a cylindrical outer end portion which is closely received in said outer bore portion, and a cylindrical inner end portion closely received in said inner bore portion, and an inwardly facing annular shoulder between said inner and outer end portions, said piston being slidably mounted in said bore for movement between a closed position wherein said annular shoulder engages said annular seat, and an open position wherein said annular shoulder is axially separated from said seat, and wherein the space between the inner end of said bore and the inner end of said inner end portion of said piston comprises a control space which communicates with said third fluid channel, said control piston being hollow and including a first radial passage positioned on the outer side of said annular shoulder and adapted to communicate with said first fluid channel of said housing, and a second radial passage positioned on the inner side of said annular shoulder and adapted to communicate with said second fluid channel of said housing, and one way valve means disposed in said hollow control piston for permitting fluid flow only in a direction from said second radial passage to said first radial passage, said control piston further including opening means extending through the wall thereof at a location between said shoulder and said second radial passage whereby fluid is adapted to flow from said first fluid channel through said opening means, through the interior of said hollow piston, and outwardly through said second radial passage and said second fluid channel when said piston is moved to said open position, spring biasing means for biasing said control piston toward its closed position, and whereby a pressurized fluid received in said control space acts to bias said piston toward said open position against the force of said spring biasing means, to thereby permit controlled flow from said first fluid channel through the interior of said control valve and to said second fluid channel.

2. The hydraulic holding valve as defined in claim 1 wherein the cross sectional area of said shoulder on said control piston is not greater than about 1/20 of the cross sectional area of the inner end of said control piston which faces said control space.

3. The hydraulic holding valve as defined in claim 1 wherein the cross sectional area of said shoulder on said control piston is between about 1/40 to 1/20 of the cross sectional area of the inner end of said control piston which faces said control space.

4. The hydraulic holding valve as defined in claim 1 wherein said valve further comprises an outer support casing having a bore therein, and said valve housing is threadedly mounted in said bore of said support casing.

5. The hydraulic holding valve as defined in claim 4 wherein a connecting plug is positioned at the inner end of said bore of said casing and between said third fluid channel and said control space, said connecting plug including a pair of passages having oppositely oriented one-way valve means in respective ones of said passages, and a restriction in each passage.

6. The hydraulic holding valve as defined in claim 4 wherein each of said first and second fluid channels includes an annular groove on the exterior surface of said valve housing, and a radial bore segment extending through said casing and communicating with the associated annular groove.

7. The hydraulic holding valve as defined in claim 4 further comprising annular packing seals positioned between said housing and casing, with said annular packings seals being located on opposite sides of each of said first and second fluid channels.

8. The hydraulic holding valve as defined in claim 4 wherein said spring biasing means comprises a pair of coaxial helical springs, and a plate engaging the outer ends of said spring, with said plate being threadedly joined to said valve housing so as to permit axial adjustment thereof.

9. The hydraulic holding valve as defined in claim 1 wherein said outer bore portion of said valve housing is closed to define a hermetically sealed cavity which receives said spring biasing means.

10. The hydraulic holding valve as defined in claim 9 further including a ventilating bore communicating with said hermetically sealed cavity.

11. The hydraulic holding valve as defined in claim 9 further comprising a fluid duct extending between said sealed cavity and said second fluid channel.

12. The hydraulic holding valve as defined in claim 1 wherein said spring biasing means comprises a pair of concentrically arranged helical coil springs, with each spring being formed of a wound wire of rectangular cross section, and with the longitudinal spacing of the coils in unloaded condition being less than the longitudinal width of the coils in cross section.

13. A hydraulic operating system comprising a hydraulic consumer having a lifting line communicating with one side thereof and a lowering line communicating with the opposite side thereof, a pressurized fluid source, control valve means for selectively connecting said pressurized fluid source to either said lifting line, said lowering line, or an external tank, and such that said lowering line is connected to said lifting line, and said lifting line is connected to said tank when said pressurized fluid source is connected to said lowering line, a hydraulic holding valve comprising (a) a valve housing having a bore therein, said bore having closed inner end, an outer end, and an outwardly facing annular seat intermediate its ends to define an inner cylindrical bore portion and an outer cylindrical bore portion which has a diameter greater than that of said inner bore portion, (b) a first fluid channel communicating with said outer bore portion and being connected to said lifting line in direct communication with said consumer, a second fluid channel communicating with said inner bore portion and being connected to said lifting line in direct communication with said control valve means, and a third fluid channel communicating with said bore immediately adjacent said inner end thereof and being connected to said lowering line, (c) a control piston slidably mounted in said bore and comprising a cylindrical outer end portion which is closely received in said outer bore portion, and a cylindrical inner end portion closely received in said inner bore portion, and an inwardly facing annular shoulder between said inner and outer end portions, said piston being slideably mounted in said bore for movement between a closed position wherein said annular shoulder engages said annular seat, and an open position wherein said annular shoulder is axially separated from said seat, and wherein the space between the inner end of said bore and the inner end of said inner end portion of said piston comprises a control space which communicates with said third fluid channel, said control piston being hollow and including a first radial passage positioned on the outer side of said annular shoulder and adapted to communicate with said first fluid channel of said housing, and a second radial passage positioned on the inner side of said annular shoulder and adapted to communicate with said second fluid channel of said housing, and one way valve means disposed in said hollow control piston for permitting fluid flow only in a direction from said second radial passage to said first radial passage, said control piston further including opening means extending through the wall thereof at a location between said shoulder and said second radial passage whereby fluid is adapted to flow from said first fluid channel through said opening means, through the interior of said hollow piston, and outwardly said second radial passage and said second fluid channel when said piston is moved to said open position, (d) spring biasing means for biasing said control piston toward its closed position, and whereby a pressurized fluid received in said control space acts to bias said piston toward said open position against the force of said spring biasing means, to thereby permit controlled flow from said first fluid channel through the interior of said control valve and to said second fluid channel.

* * * * *

UNITED STATES PATENT AND TRADEMARK OFFICE

CERTIFICATE OF CORRECTION

PATENT NO. : 4,727,792

DATED : Mar. 1, 1988

INVENTOR(S) : Hubert Haussler

It is certified that error appears in the above-identified patent and that said Letters Patent is hereby corrected as shown below:

In column 10, line 24, after "to", insert -- said tank when said pressurized fluid source is connected to --.

In column 11, line 11, after "outwardly", insert -- through --.

Signed and Sealed this

Ninth Day of August, 1988

*Attest:*

*Attesting Officer*

DONALD J. QUIGG

*Commissioner of Patents and Trademarks*